US009235937B1

(12) United States Patent
Weinberg

(10) Patent No.: US 9,235,937 B1
(45) Date of Patent: Jan. 12, 2016

(54) MOUNTING METHOD FOR SATELLITE CRASH SENSORS

(71) Applicant: Analog Devices, Inc., Norwood, MA (US)

(72) Inventor: Harvey Weinberg, Sharon, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 14/297,255

(22) Filed: Jun. 5, 2014

Related U.S. Application Data

(60) Provisional application No. 61/831,338, filed on Jun. 5, 2013.

(51) Int. Cl.
*G07C 5/00* (2006.01)

(52) U.S. Cl.
CPC ..... *G07C 5/008* (2013.01)

(58) Field of Classification Search
CPC ..... G01P 1/02; H01L 21/673; H01L 21/6779; H01L 21/68778; H01L 2924/15; H01L 2924/171; H01L 2924/1711; H01L 2924/1715; H01L 2924/17151; H01L 2924/181; H01L 2924/1811; G07C 5/008
See application file for complete search history.

(56) References Cited

U.S. PATENT DOCUMENTS

| | | | | |
|---|---|---|---|---|
| 4,017,187 | A | 4/1977 | Schwartz | 356/106 LR |
| 4,266,421 | A | 5/1981 | McDougal | 73/1 DV |
| 4,347,743 | A | 9/1982 | Rausche et al. | 73/654 |
| 4,823,602 | A | 4/1989 | Christensen, Jr. et al. | 73/661 |
| 4,905,518 | A | 3/1990 | Kubler | 73/654 |
| 4,947,690 | A | 8/1990 | Cleveland | 73/654 |
| 4,959,792 | A | 9/1990 | Sullivan | 364/579 |
| 5,062,310 | A | 11/1991 | Eaton | 73/866.5 |
| 5,187,328 | A | 2/1993 | Burgess et al. | 174/52.2 |
| 5,223,844 | A | 6/1993 | Mansell et al. | 342/357 |
| 5,233,871 | A | 8/1993 | Schwarz et al. | 73/493 |
| 5,297,976 | A | 3/1994 | VanDerStuyf et al. | 439/271 |
| 5,611,731 | A | 3/1997 | Bouton et al. | 463/37 |
| 5,644,081 | A | 7/1997 | Schwarz et al. | 73/493 |
| 5,659,950 | A | 8/1997 | Adams et al. | 29/827 |
| 5,719,334 | A | 2/1998 | Parsons | 73/514.01 |
| 5,733,135 | A | 3/1998 | Kennedy et al. | 439/188 |
| 5,749,059 | A | 5/1998 | Walton | 701/45 |
| 5,825,098 | A | 10/1998 | Darby et al. | 307/10.1 |
| 5,835,873 | A | 11/1998 | Darby et al. | 701/45 |
| 5,847,278 | A | 12/1998 | Judd | 73/493 |
| 5,885,088 | A * | 3/1999 | Brennan et al. | 439/680 |
| 5,910,993 | A | 6/1999 | Aoki et al. | 381/71.12 |

(Continued)

FOREIGN PATENT DOCUMENTS

| | | | |
|---|---|---|---|
| EP | 2 187 222 | 5/2010 | G01P 1/02 |

OTHER PUBLICATIONS

"New Surface Mircomachined Angular Rate Sensor for Vehicle Stabilizing Systems in Automotive Applications", Gomez, et al., 13th International Conferecne on Solid-State Sensors, Actuators and Microsystems, Seoul, Korea, Jun. 5-9, 2005.*

*Primary Examiner* — Rodney Butler
(74) *Attorney, Agent, or Firm* — Sunstein Kann Murphy & Timbers LLP

(57) ABSTRACT

A satellite sensor system includes a base unit and a packaged motion sensor configured to be removably couplable to the base unit. The base unit is configured to mount to a vehicle and to faithfully transmit vehicle motion to an attached sensor.

20 Claims, 8 Drawing Sheets

(56) References Cited

U.S. PATENT DOCUMENTS

| | | | | |
|---|---|---|---|---|
| 5,912,442 | A | 6/1999 | Nye et al. | 181/292 |
| 5,918,292 | A | 6/1999 | Smith | 73/866.5 |
| 5,927,680 | A | 7/1999 | Bridges et al. | 248/638 |
| 5,939,633 | A | 8/1999 | Judy | 73/514.32 |
| 5,950,973 | A | 9/1999 | Verma | 248/222.51 |
| 6,005,241 | A * | 12/1999 | Doty et al. | 250/222.1 |
| 6,029,530 | A | 2/2000 | Patton et al. | 73/866.5 |
| 6,070,531 | A | 6/2000 | Hansen et al. | 102/202.5 |
| 6,168,197 | B1 | 1/2001 | Paganini et al. | 280/735 |
| 6,182,508 | B1 | 2/2001 | Takeuchi et al. | 73/493 |
| 6,199,874 | B1 | 3/2001 | Galvin et al. | 280/5.514 |
| 6,202,491 | B1 | 3/2001 | McCarty et al. | 73/659 |
| 6,205,872 | B1 | 3/2001 | Pflueg | 73/866.5 |
| 6,236,920 | B1 | 5/2001 | Hora | 701/45 |
| 6,290,037 | B1 | 9/2001 | Williams et al. | 188/379 |
| 6,326,704 | B1 | 12/2001 | Breed et al. | 307/9.1 |
| 6,398,252 | B1 | 6/2002 | Ishikawa et al. | 280/727 |
| 6,400,044 | B1 | 6/2002 | Lohberg et al. | 307/91 |
| 6,425,293 | B1 | 7/2002 | Woodroffe et al. | 73/756 |
| 6,435,902 | B1 | 8/2002 | Groh et al. | 439/527 |
| 6,459,042 | B1 | 10/2002 | Stilianos et al. | 174/138 |
| 6,484,589 | B1 | 11/2002 | Brock | 73/861.18 |
| 6,494,186 | B1 | 12/2002 | Wakeman | 123/479 |
| 6,505,511 | B1 | 1/2003 | Geen et al. | 73/504.12 |
| 6,533,316 | B2 | 3/2003 | Breed et al. | 280/735 |
| 6,546,814 | B1 | 4/2003 | Choe et al. | 73/862.08 |
| 6,557,889 | B2 | 5/2003 | Breed | 280/735 |
| 6,711,951 | B2 | 3/2004 | Kicher et al. | 73/493 |
| 6,722,925 | B2 * | 4/2004 | Skofljanec | 439/680 |
| 6,733,036 | B2 | 5/2004 | Breed et al. | 280/735 |
| 6,738,697 | B2 | 5/2004 | Breed | 701/29 |
| 6,756,697 | B2 | 6/2004 | Mizutani et al. | 307/10.1 |
| 6,757,262 | B1 | 6/2004 | Weisshaar et al. | 370/310 |
| 6,771,166 | B2 | 8/2004 | Mastenbrook | 340/425.5 |
| 6,794,728 | B1 | 9/2004 | Kithil | 257/532 |
| 6,823,244 | B2 | 11/2004 | Breed | 701/29 |
| 6,851,306 | B2 | 2/2005 | Shost et al. | 73/119 R |
| 6,851,710 | B2 | 2/2005 | Wong et al. | 280/743.2 |
| 6,854,760 | B2 | 2/2005 | Whited et al. | 280/732 |
| 6,918,297 | B2 | 7/2005 | MacGugan | 73/504.15 |
| 6,941,206 | B2 | 9/2005 | Hasegawa et al. | 701/38 |
| 6,964,209 | B2 | 11/2005 | Robinson et al. | 73/866.5 |
| 6,988,417 | B2 | 1/2006 | Kushwaha et al. | 73/856 |
| 6,991,256 | B2 | 1/2006 | Henderson et al. | 280/730.2 |
| 7,040,166 | B2 | 5/2006 | Babala | 73/514.35 |
| 7,047,349 | B2 | 5/2006 | Carpenter | 710/316 |
| 7,048,423 | B2 | 5/2006 | Stepanenko | 362/507 |
| 7,089,099 | B2 | 8/2006 | Shostak et al. | 701/32 |
| 7,098,778 | B1 | 8/2006 | Zoratti et al. | 340/436 |
| 7,134,334 | B2 | 11/2006 | Schirmer et al. | 73/493 |
| 7,154,387 | B2 | 12/2006 | Boomershine, III | 340/467 |
| 7,161,087 | B2 | 1/2007 | Hunkeler et al. | 174/153 G |
| 7,181,968 | B2 | 2/2007 | Still | 73/493 |
| 7,196,404 | B2 | 3/2007 | Schirmer et al. | 257/676 |
| 7,237,796 | B2 | 7/2007 | Barker et al. | 280/728.2 |
| 7,240,917 | B2 | 7/2007 | Fogle, Jr. et al. | 280/739 |
| 7,242,929 | B2 | 7/2007 | Draluk et al. | 455/419 |
| 7,272,481 | B2 | 9/2007 | Einig et al. | 701/70 |
| 7,284,769 | B2 | 10/2007 | Breed | 280/735 |
| 7,377,961 | B2 * | 5/2008 | McDonald | 96/4 |
| 7,421,088 | B2 | 9/2008 | Cranfill et al. | 381/386 |
| 7,444,231 | B2 | 10/2008 | Ancimer et al. | 701/111 |
| 7,461,859 | B2 | 12/2008 | Fogle, Jr. et al. | 280/739 |
| 7,468,692 | B1 | 12/2008 | Wiegers | 342/357.06 |
| 7,481,453 | B2 | 1/2009 | Breed | 280/738 |
| 7,500,394 | B2 | 3/2009 | Steele | 73/493 |
| 7,502,677 | B2 | 3/2009 | Weichenberger et al. | 701/45 |
| 7,527,288 | B2 | 5/2009 | Breed | 280/735 |
| 7,549,673 | B2 | 6/2009 | Suzuki et al. | 280/732 |
| 7,555,370 | B2 | 6/2009 | Breed et al. | 701/2 |
| 7,594,423 | B2 | 9/2009 | Padhi et al. | 73/35.09 |
| 7,635,043 | B2 | 12/2009 | Breed | 180/282 |
| 7,648,164 | B2 | 1/2010 | Breed | 280/736 |
| 7,711,460 | B2 | 5/2010 | Yakes et al. | 701/22 |
| 7,726,242 | B2 | 6/2010 | Stevens | 102/202.12 |
| 7,744,122 | B2 | 6/2010 | Breed | 280/731 |
| 7,762,134 | B2 | 7/2010 | Katsumata | 73/504.12 |
| 7,819,004 | B2 | 10/2010 | Steele et al. | 73/493 |
| 7,832,762 | B2 | 11/2010 | Breed | 280/735 |
| 7,966,113 | B2 | 6/2011 | Kroehnert et al. | 701/41 |
| 7,991,535 | B2 | 8/2011 | Gittere | 701/102 |
| 8,019,501 | B2 | 9/2011 | Breed | 701/29 |
| 8,051,712 | B2 | 11/2011 | Younsi et al. | 73/493 |
| 8,060,282 | B2 | 11/2011 | Breed | 701/48 |
| 8,078,339 | B2 | 12/2011 | Oakes | 701/1 |
| 8,096,182 | B2 | 1/2012 | Lin et al. | 73/514.32 |
| 8,116,940 | B2 | 2/2012 | Keller | 701/39 |
| 8,116,947 | B2 | 2/2012 | Giordano | 701/45 |
| 8,180,585 | B2 | 5/2012 | Cech et al. | 702/65 |
| 8,225,659 | B2 | 7/2012 | Sugibayashi et al. | 73/504.12 |
| 8,229,624 | B2 | 7/2012 | Breed | 701/36 |
| 8,234,034 | B2 | 7/2012 | Brisighella, Jr. et al. | 701/29.1 |
| 8,244,425 | B2 | 8/2012 | Tauchi et al. | 701/29.1 |
| 8,253,301 | B2 | 8/2012 | Nishino et al. | 310/313 D |
| 8,340,857 | B2 | 12/2012 | Brisighella, Jr. et al. | 701/29.1 |
| 8,346,438 | B2 | 1/2013 | Breed | 701/45 |
| 8,366,497 | B2 | 2/2013 | Glick et al. | 439/839 |
| 8,384,538 | B2 | 2/2013 | Breed | 340/500 |
| 8,401,207 | B2 | 3/2013 | Stanley | 381/96 |
| 8,401,739 | B2 | 3/2013 | Helldorfer et al. | 701/45 |
| 8,712,599 | B1 | 4/2014 | Westpfahl | 701/1 |
| 8,966,975 | B2 | 3/2015 | Campbell et al. | 73/493 |
| 2002/0158455 | A1 * | 10/2002 | Bergerson et al. | 280/737 |
| 2004/0163470 | A1 | 8/2004 | Babala et al. | 73/514.01 |
| 2007/0062274 | A1 * | 3/2007 | Chikenji | B81B 7/0077 73/152.55 |
| 2007/0084270 | A1 * | 4/2007 | Jarrett | G01M 3/3281 73/49.2 |
| 2009/0255335 | A1 * | 10/2009 | Fly | G01C 19/5719 73/493 |
| 2011/0004360 | A1 | 1/2011 | Kolatschek | 701/1 |
| 2011/0209551 | A1 | 9/2011 | Helldorfer et al. | 73/658 |
| 2013/0131929 | A1 | 5/2013 | Bortolin | 701/45 |
| 2014/0172237 | A1 | 6/2014 | Uchida et al. | 701/46 |
| 2014/0354422 | A1 * | 12/2014 | Olson et al. | 340/465 |

* cited by examiner

MOUNTING METHOD FOR SATELLITE CRASH SENSORS

RELATED APPLICATIONS

This patent application claims priority from provisional U.S. patent application No. 61/831,338, filed Jun. 5, 2013, entitled, "Mounting Method for Satellite Crash Sensors," and naming Harvey Weinberg as inventor, the disclosure of which is incorporated herein in its entirety.

TECHNICAL FIELD

The present invention relates to satellite sensors in a vehicle, and more particularly to mounting satellite sensors in vehicles.

BACKGROUND ART

It is known in the prior art to use satellite sensors in a vehicle to monitor various vehicle motions for the purposes of engaging safety systems. For example, an accelerometer might be mounted to a vehicle for determining whether the vehicle has been in a crash. The accelerometer's output signal or data is typically processed by an electronic control unit ("ECU") or other vehicle system to determine whether to deploy an airbag, or other vehicle safety system.

Such satellite sensors are typically mounted on circuit boards along with other components such as a wiring harness interface, and sealed in a housing to create a satellite sensor module. The module is then secured to the vehicle. During the manufacture of the vehicle, a worker attaches a flexible portion of the vehicle's wiring harness to the wiring interface in the housing. As such, a satellite sensor module is expensive to manufacture and test, and installing a satellite sensor module is expensive and labor intensive, and replacing or repairing a satellite sensor module is also expensive and labor intensive.

SUMMARY OF THE EMBODIMENTS

A first embodiment of a device for removably coupling a MEMS sensor to a vehicle includes a body, the body not including a MEMS sensor; a mounting device coupled to the body, and configured to affix the body to the vehicle; and a sensor interface coupled to the body, the sensor interface configured to accept a MEMS sensor module. In other embodiments, a device for coupling a MEMS sensor to a vehicle, includes a body forming a sensor interface; a cable integrally extending from the body; and a mounting device coupled to the body, and configured to affix the body to the vehicle, the sensor interface configured to accept a MEMS sensor module, the MEMS sensor module being electrically connected with the cable when accepted by the sensor interface.

In some embodiments, the sensor interface configured to removably accept a MEMS sensor module, and in some embodiments, the sensor interface is configured to provide an electrical interface with the MEMS sensor module, and the device further comprising a wiring harness interface. The harness interface may be configured to electrically couple directly to a MEMS sensor module when such a MEMS sensor module is coupled to the sensor interface, such that the MEMS sensor module is not in electrical contact with the body.

The sensor interface may further be configured such that the electrical interface is environmentally sealed when a sensor module is coupled to the sensor interface. To that end, a sensor module and/or a base unit may include a sealing member.

In some embodiments, the body further comprises a local power storage element, such as a battery for example, configured to provide power to a MEMS sensor module when such a MEMS sensor module is coupled to the sensor interface.

In some embodiments, mounting device includes an aperture passing completely through the body, and configured to receive a fastener and to allow the fastener to physically couple to the vehicle. The aperture may have a circular or non-circular cross-section, and may include internal threads. In other embodiments, the mounting device includes a threaded shank.

In another embodiment, a packaged MEMS sensor includes a support structure, the support structure comprising a plurality of legs, each of the legs having a mounting end and a distal end, and having a thickness of greater than 0.32 inches; a MEMS sensor physically coupled to the legs; and a casing encapsulating the MEMS sensor and partially encapsulating the support structure, such that the distal ends of the legs are exposed, and are configured to removably couple to a sensor interface in a vehicle mounting apparatus. The casing may be configured to mate with the sensor interface so as to form an environmental barrier surrounding the plurality legs.

According to various embodiments, each of the plurality of legs may be electrically conductive, and electrically isolated from each of the remaining legs, and the MEMS sensor is electrically coupled to the plurality of legs.

In some embodiments, each of the plurality of legs is electrically isolated from each of the remaining plurality of legs, and each of the plurality of legs is configured to carry an electrical signal to and/or from the MEMS sensor.

In some embodiments, the packaged MEMS sensor also includes a wireless communications circuit configured to communicate with a host vehicle, and each of the plurality of legs is non-conductive. Also, in some embodiments, the MEMS sensor includes a wireless communications circuit configured to communicate with the vehicle, and each of the plurality of legs is electrically conductive and is electrically coupled to each of the remaining plurality of legs.

In some embodiments, the sensor also includes a pull tab extending from the casing. The pull tab may be part of the support structure.

According to another embodiment, a method of fabricating a satellite sensor assembly includes providing a MEMS sensor die; production testing the MEMS sensor die; fabricating a sensor assembly by mounting the MEMS sensor die onto a substrate and overmolding the substrate and its sensor; production testing the sensor assembly; and installing the sensor assembly in the vehicle without further production testing.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Various embodiments provide simpler, more cost-effective satellite sensor systems that are also easier to install and maintain than previous satellite sensor systems. A first embodiment includes a packaged sensor device configured to be coupled and removed from a base unit. The base unit is configured to be affixed to the vehicle so as to faithfully transmit motion of the vehicle to a sensor coupled to the base unit. In some embodiments, the sensor system may be configured for wireless communication with an ECU or other vehicle system, while in other embodiments the base unit includes a wiring harness interface that provides for power and/or communications connections between the wiring harness and the sensor. As such, the sensor is easily installed, and easily removed and replaced.

Figure 1A:
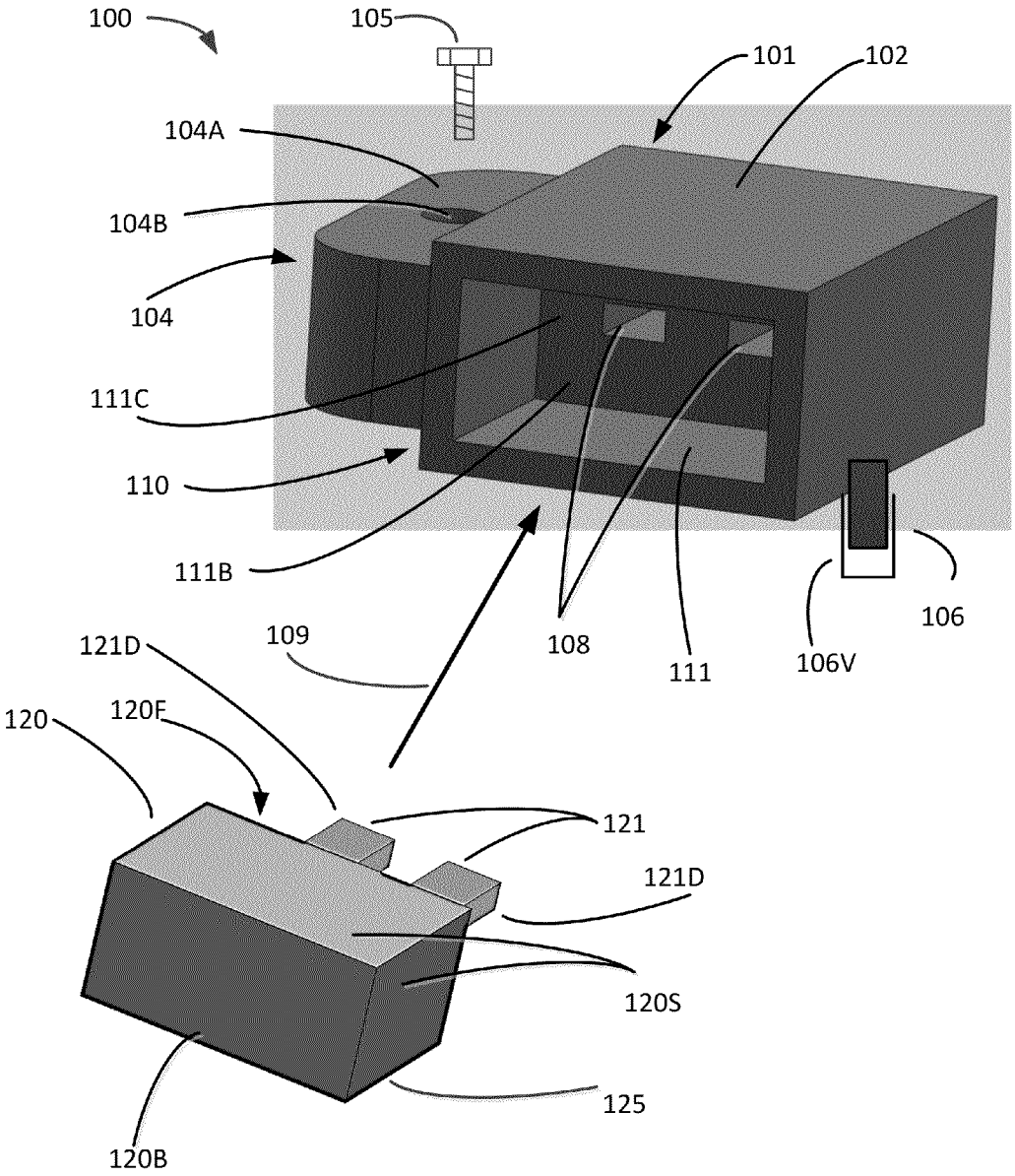
FIG. 1A schematically illustrates an embodiment of a satellite sensor mounting system.

An embodiment of a satellite sensor system 100 is schematically illustrated in FIG. 1A, and includes a base 101 and a sensor module 120. The base unit 101 is configured to attach to a vehicle and is configured to separably couple to the sensor module 120, and the sensor module 120 is configured to removably attach to the base unit 101. Various embodiments of base unit bodies or mounting bodies (e.g., 102) and sensor modules (e.g., 120) are schematically illustrated in additional figures, as described below.

The base unit 101 includes a body 102 having a sensor interface 110 configured to receive a sensor (e.g. sensor module 120), and to be affixed to a vehicle. In various embodiments, the sensor interface 110 and sensor module 120 are configured such that the sensor module 120 is removable from the sensor interface 110, and therefore removable from body 102. In other words, the sensor module 120 may be inserted or installed into body 102 such that the sensor module is affixed to the vehicle and is functional for its intended purpose (e.g., sensing vehicle motion), and yet can be selectively removed, for example in the case of repair or replacement. In preferred embodiments, when a sensor module 120 is affixed to a host vehicle via a body 102, the sensor module 120 will receive at least 90% of the energy of a vibration or other motion of the host vehicle through the base unit 101. In other embodiments, the sensor module 120 will receive at least 95% or 99% or 100% of such energy.

To that end, in some embodiments, the base unit 101 includes, or is coupled to, a mounting device, or mounting interface 104 configured to mount the body 102 to the vehicle. For example, in the embodiment of FIG. 1A, the mounting interface includes a mounting tab 104A having a fastener aperture 104B. The fastening aperture 104B passes completely through the mounting tab 104A and is configured to allow a fastener 105, such as a threaded screw, pin, rivet, or cotter pin to name but a few examples, to pass through the mounting tab 104A and attach to the vehicle. In some embodiments, the fastening aperture 104B is threaded (e.g., has internal threads) to mate with a threaded fastener, while in other embodiments, the fastening aperture 104B has a smooth bore.

In some embodiments, the fastening aperture 104B has a cylindrical shape, and therefore has a circular cross-section. In other embodiments, however, the fastening aperture 104B has an oval, elliptical, or other non-circular cross section, and fastener 105 has a matching cross-section, such that the shapes cooperate to resist rotation of the body 102 around the fastener 105.

In some embodiments, the mounting tab 104A is integral to the body 102, but in other embodiments, the mounting tab 104A may be a separate device attached to the body 102.

In some embodiments, the body 102 and/or the mounting tab 104A includes an anti-rotation pin 106 or other device that prevents the body 102 from rotating around the fastener 105 when the body 102 is mounted to a vehicle via a fastener. To that end, the anti-rotation pin 106 is configured to fit into a corresponding aperture or trench 106V in the vehicle. In the embodiment of FIG. 1A, the anti-rotation pin 106 extends from the body 120 in a direction parallel to the axis of aperture 104B, such that the anti-rotation pin 106 is parallel to the fastener 105.

Another embodiment of a body 102A is schematically illustrated in FIG. 1A, and includes two mounting tabs 104 as described above, as well as an anti-rotation pin 106, and many other features of body 102 of FIGS. 1A-1D.

In other embodiments, the body 102 is molded or otherwise integral to another element of its host vehicle, such as a bracket that serves another purpose within the vehicle. In such embodiments, the body is affixed to the vehicle as part of the bracket, and would not require an additional mounting device 104. A sensor module 120 may then be installed into a sensor interface 110 of the body, as with other embodiments.

Figure 2A:
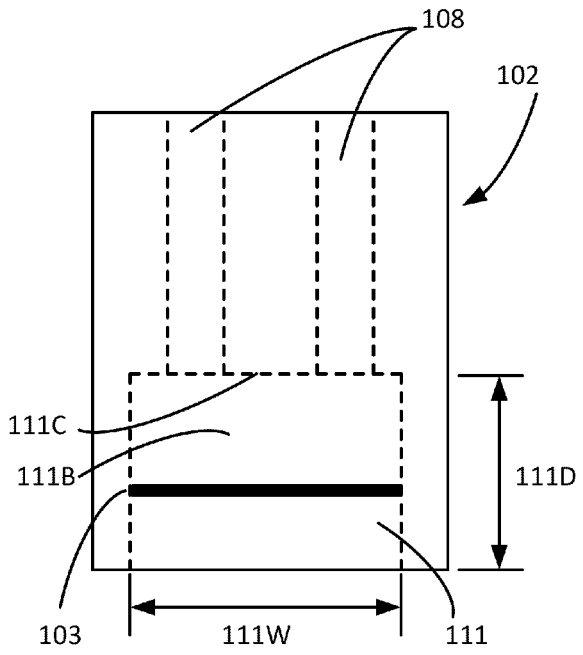
FIGS. 2A-2C schematically illustrate various embodiments of a mounting body in orthographic views.
Figure 2B:
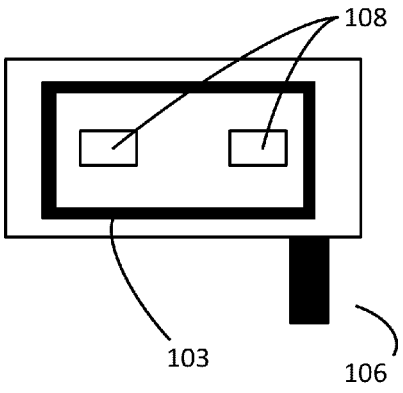
Figure 2C:
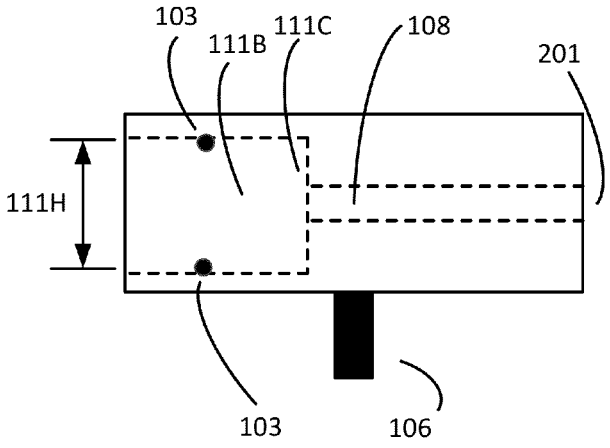

The body 102 also includes a sensor interface 110 configured to accept a sensor module (e.g., sensor module 120, for example). In the embodiment of FIG. 1A, the sensor interface 110 is defined in part by a cavity 111 in the body 102. The inner dimensions of the cavity 111 (e.g., height 111H, width 111W, depth 111D; see FIGS. 2A-2C; see, e.g., FIGS. 4A-4C) are greater than the corresponding outside dimensions (e.g., height 120H, width 120W, depth 120D) of a corresponding sensor module (e.g., 120), such that the sensor module, or at least a portion of a sensor module, fits into the cavity 111. As indicated by the arrow 109 of FIG. 1A, one face 102F and at least a portion of the sides 102S of the sensor module 120 may be inserted into cavity 111.

Figure 1B:
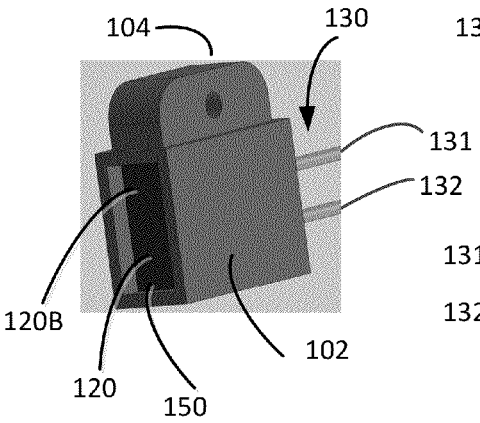
FIGS. 1B and 1C schematically illustrate various embodiments of a sensor module coupled with a mounting body.
Figure 1C:
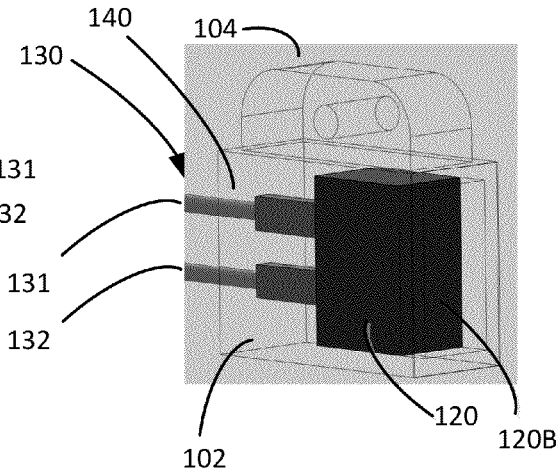

FIG. 1B and FIG. 1C schematically illustrate a system 100 in which a sensor module 120 is inserted into a body 102. In these embodiments, the sensor module 120 fits completely into the cavity 111, such that no part of the sensor module 120 extends from the cavity 111. Nevertheless, the sensor module 120 is not completely encapsulated by the body 102, because at least one face (e.g., 120B) of the sensor module is exposed from within the cavity 111. Indeed, in some embodiments, a portion of the cavity 111 not occupied by the sensor module 120 may be filled with a sealing material 150 so as to secure, and in some embodiments even to seal, the sensor module 120 within the body 102. In other embodiments, a portion of the sensor module 120 may extend from the body 102, such as from cavity 111.

In some embodiments, the cavity 111 and sensor module 120 fit together so as to form an environmental barrier or seal against the incursion into the cavity 111 of contaminants, such as moisture or dust, etc., that might interfere with the interface (e.g., physical or electrical interface) between the sensor module 120 and the body 102. In particular, such an environmental barrier or seal prevents or hinders the incursion of such contaminants to the inside end 111B of the cavity 111. For example, in some embodiments, the environmental barrier is configured to meet or exceed the IP67 standard.

To that end, the dimensions (111H, 111W and 111D) of the cavity 111 and the sensor module 120 are configured such that the sensor module 120 fits snugly into the cavity 111. In other embodiments, however, one or both of the body 102 and sensor module 120 may include a gasket or seal member 103 to interface between the body 102 and sensor module 120, as in FIG. 2C for example. The gasket or seal member 103 forms an environmental barrier that prevents or impedes the incursion of contaminants to the inside end 111B of the cavity 111. For example, in some embodiments, the environmental barrier is configured to meet or exceed the IP67 standard. In such embodiments, the inside end 111B of the cavity 111 may be defined as that portion of the cavity 111 between the gasket or seal member 103 and the back end 111C of the cavity 111.

As schematically illustrated in the embodiments of FIG. 1B and FIG. 1C, sensor module 120 is within the body 102, but is still exposed. More specifically, a face 120B of the sensor module 120 remains exposed to the external environment, and is even visible from outside the body 120.

Figure 1D:
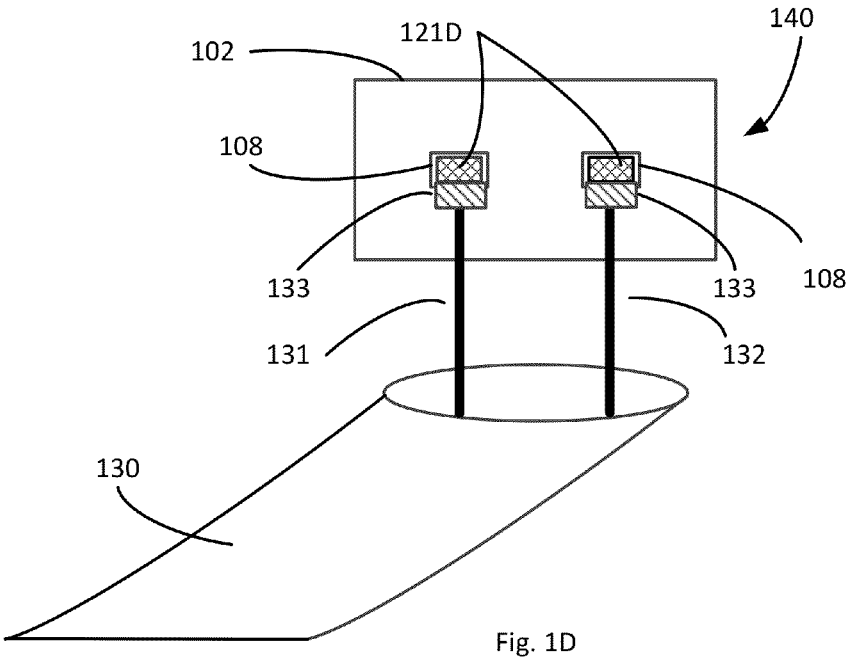
FIG. 1D schematically illustrates an embodiment of a wiring harness interface.
Figure 1E:
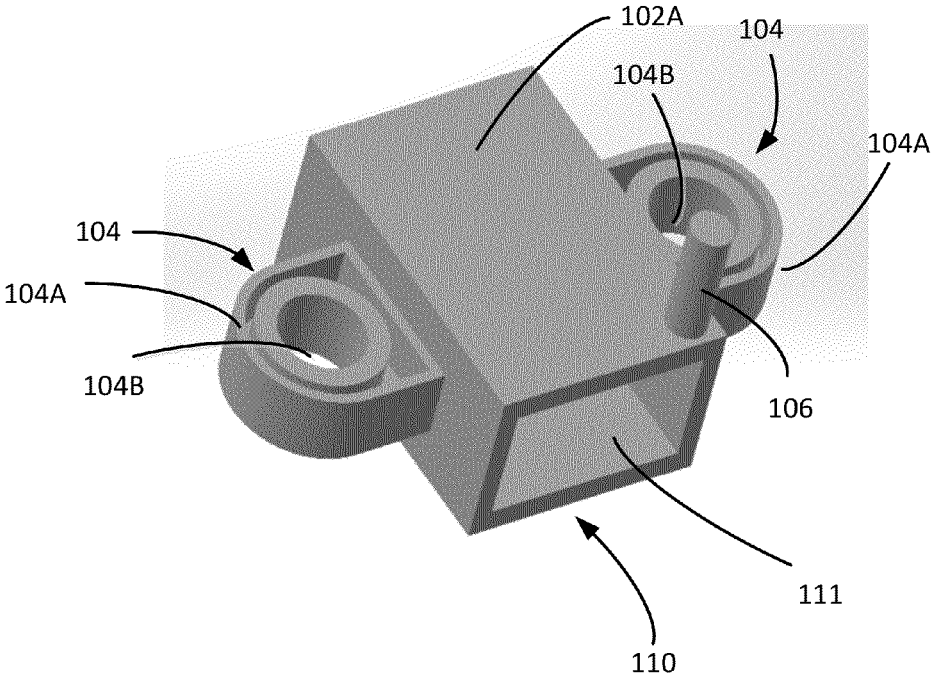
FIG. 1E schematically illustrates an embodiment of a sensor module.

When a sensor module 120 is coupled to a base 102 via mounting interface 110, each of the legs 121 of the sensor module 120 extends into a corresponding one of the apertures 108. Indeed, in some embodiments, the legs 121 may extend completely through the apertures 108 and exit the body 102. For example, in FIG. 1C, the legs 121 of sensor module 120 extend through the body 102 (which is schematically illustrated as translucent in FIG. 1C for purposes of illustration) to provide a wiring harness interface 140 to connect with corresponding conductors 131, 132 of wiring harness (or cable) 130. Indeed, in some embodiment's, apertures 108 may be lined with a conductive material, or may include a conductive liner, or may otherwise be conductive, so provide an electrical interface to legs 121. In other embodiments, however, the body 102, or at least the apertures 108, are not conductive, so that the sensor module 120 is not in electrical contact with the body 102. In some embodiments, as schematically illustrated in FIG. 1D, the vehicle's wiring harness 130 includes connectors 133 configured to insert within the apertures 108 and make a physical and electrical connection to the legs 121, such that there is a direct electrical connection between the sensor module 120 and the wiring harness 130. In some embodiments, the wiring harness (or cable) 130 may be integrally coupled to the body 102 (e.g., integrally extend from the body 102). In such embodiments, the cable 130 could not be removed or detached from the body 102 without damaging or destroying the cable 130, the body 102, or both. As such, the body 102 may secure, or help to secure, the wiring harness or cable 130 to the vehicle.

Figure 3A:
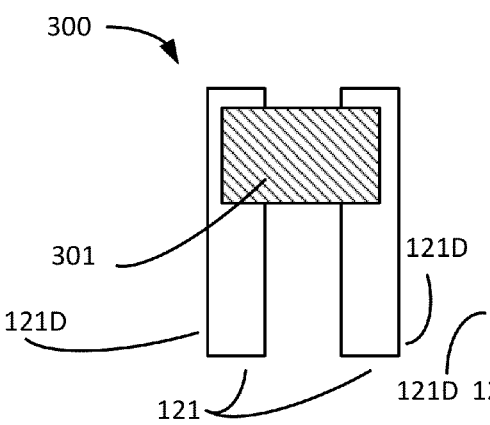
FIGS. 3A-3D schematically illustrate various embodiments and features of certain components of a sensor module.
Figure 3B:
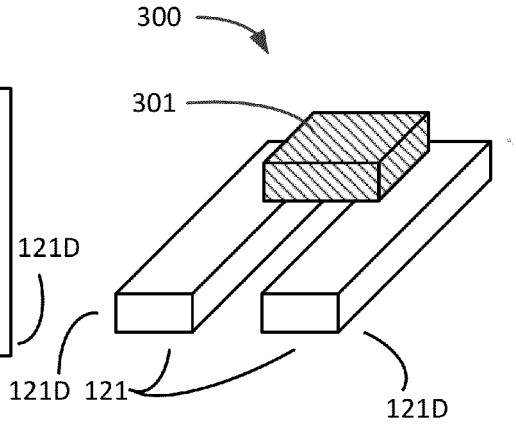

FIGS. 3A and 3B schematically illustrate certain internal components of a sensor module 120.

Generally, the sensor 301 is a sensor (e.g., a micromachined or MEMS sensor) configured to sense one or more motions of a moving vehicle, and may include, without limitation, inertial sensors such as accelerometers and gyroscopes, bulk acoustic wave gyroscopes, etc. A "wireless sensor" is a sensor that includes (or is part of a system or module that includes) communications interface circuitry configured to communicate wirelessly with, for example, with an electronics control unit ("ECU") of a vehicle. Typically, a sensor 301 is configured to monitor vehicle motions that may indicate a need to deploy a safety system (e.g., a crash sensor configured to detect a sudden deceleration in order to deploy an air bag). In some embodiments, the sensor 301 may be configured to produce a digital output (e.g., it may include an analog-to-digital converter).

In the embodiment of FIGS. 3A and 3B, the sensor module includes two legs 121 and a sensor 301. The sensor 301, and portions (121E) of the legs 121 are enclosed or encapsulated into package or casing 125, while distal ends 121D of the legs 121 are exposed from the package. The sensor may be an accelerometer or gyroscope, to name but a few examples. The package or casing 125 may be injection molded polymer, as known in the art, or may include multiple parts that snap or fit together around the internal portions of the sensor module 120.

Figure 3C:
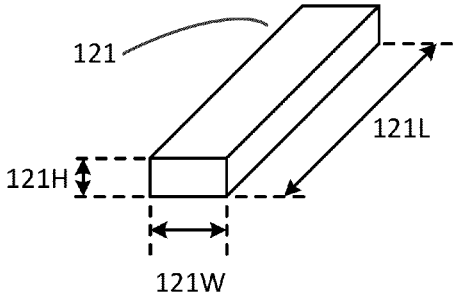
Figure 3D:
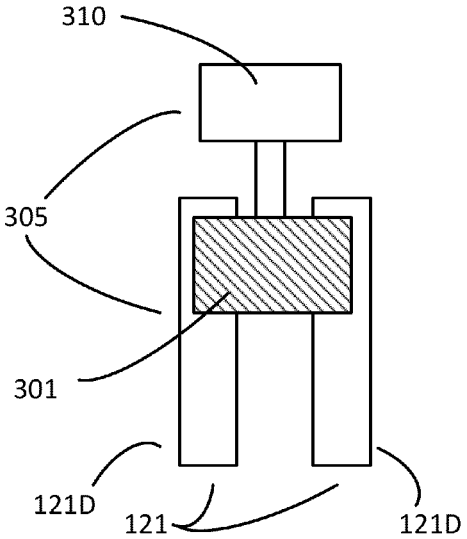

In some embodiments, the legs 121 serve multiple functions. For example, the legs 121 serve a structural function. To that end, the legs must be sufficiently rigid and strong to provide a suitable connection to a base 102. Such a physical or mechanical connection must be sufficient to faithfully transmit vibrations or other motions of the vehicle to the sensor 301. For example, in some embodiments, the legs have a width 121W of 0.33 inches and a height 121H of about, less than or equal to 0.32 inches, as schematically illustrated in FIG. 3C. In some embodiments, at least one of the height 121H or the width 121W of at least one leg 121 is greater than 0.32 inches.

Further, in some embodiments, the legs serve an electrical function. In particular, in some embodiments the legs 121 are conductive and electrically isolated from one another. The sensor 301 is electrically coupled to the legs 121, such that the legs 121 serve to provide power to the sensor 301 (e.g., electrical power from the vehicle's electrical system via a wiring harness coupled to a body 102) and/or carry signals to and/or from the sensor 301, for example signals to and/or from the vehicle's electronics control unit.

In other embodiments, the legs 121 are conductive, but are do not provide a power or signal interface with the sensor 301. In such embodiments, one or more legs, and/or a pull tab 130 as discussed below, may be electrically coupled to provide EMI protection for the sensor 301.

In preferred embodiments, the legs 121 interface to the body 102 without solder or other conductive or non-conductive intermediary. In other embodiments, the legs extend through the body 102 and couple directly to the vehicle's wiring harness.

In some embodiments, however, one or more of the legs 121 may be non-conductive, and may thus serve only a structural function, such as in a sensor module 120 having a local power source (e.g., battery) and a wireless communications interface.

In addition, some embodiments include a pull tab 310 to facilitate removal of a sensor module 120 from a body 102, for example when the sensor module needs to be replaced. To that end, a pull tab 310 has an internal portion 310A configured to be encapsulated with other elements of the sensor module 120, and an external portion 310B configured to extend outside of the sensor module's housing 125 so as to be available to a user. In some embodiments, the pull tab 310 is a part of the support structure (or support framework) 305, and in some embodiments, the internal portion 310A is coupled to the sensor 301, for example to provide physical support for the sensor.

Figure 4D:
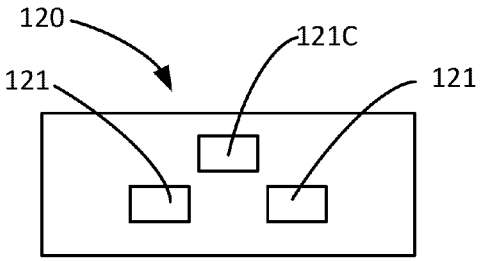
FIGS. 4D-4E schematically illustrate various embodiments of sensor module leg configurations.
Figure 4E:
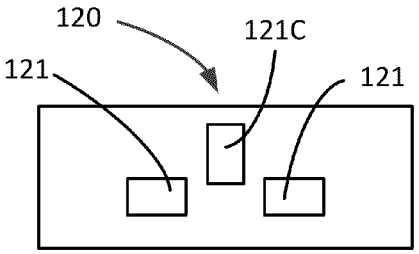
Figure 4A:
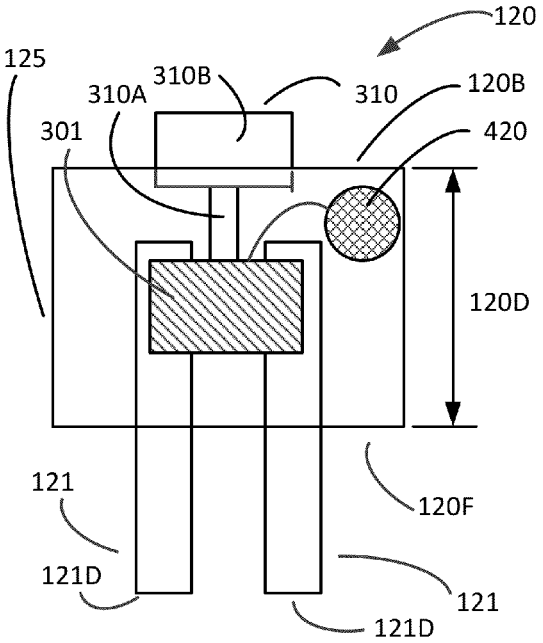
FIGS. 4A-4C schematically illustrate various embodiments of a sensor module in orthographic views.
Figure 4F:
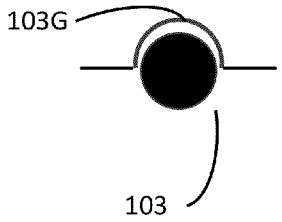
FIG. 4F schematically illustrates a gasket and groove.
Figure 4B:
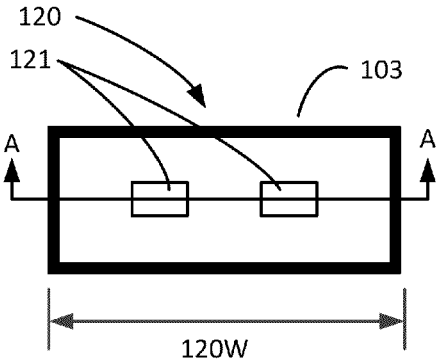
Figure 4C:
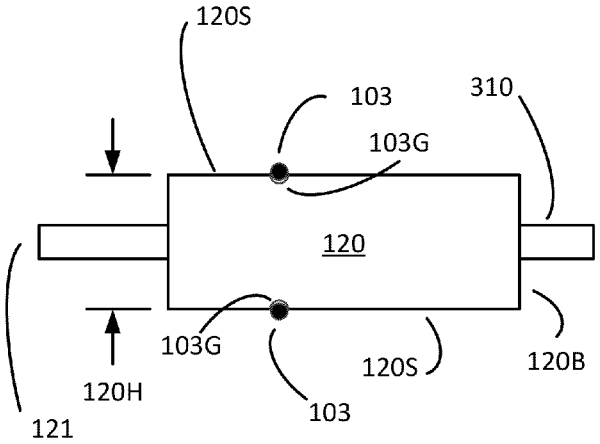

FIGS. 4A-4E schematically illustrate embodiments of sensor module 120. FIG. 4A is a cross-section (A-A) of a sensor module 120 and schematically illustrates the sensor module 120 having two legs 121 and a sensor 301 enclosed in a casing 125. FIG. 4A does not show a seal member 103, to avoid cluttering the figure, but a seal member 103 is schematically illustrated in FIGS. 4B and 4C. The seal member 103 forms a continuous barrier or ring around the inside of cavity 111. The sensor 301, and a portion of each leg 121, and a portion (310A) of the (optional) pull tab 310 are within the casing 125, while a distal portion 121D of each leg 121, and a portion (310B) are outside of the casing 125.

In the various embodiments, the casing 125 has a 6-sided shape, with a depth (120D), width (120W) and height (120H) as schematically illustrated in FIGS. 4A-4C.

In embodiments that include a seal member 103, the casing 125 may include a groove 103G to partially accept the seal member 103, and to secure the seal member 103 in place. A seal member 103 is schematically illustrated in FIGS. 4B and 4C. FIG. 4F includes a larger schematically illustration of a seal member 103 disposed in a groove 103G as in FIG. 4C for example, although when a sensor is installed in the cavity 111 the seal member 103 would be pressed further into the groove 103.

Some embodiments include a local power source 420, such as a battery for example. The power source 420 is electrically coupled to the sensor 301 and configured to supply operating power to the sensor 301. As such, some embodiments do not draw, or do not need to draw, power from a host vehicle's power systems. If the sensor 301 includes a wireless interface, the sensor module 120 may not need to have any hardwired connection to the vehicle's electrical system, and as such may not have an electrical connection to the vehicle's wiring harness.

Some embodiments of sensor modules 120 may have more than two legs 121. For example, some embodiments have may have three or more legs 121. Some embodiments having three legs 121 are schematically illustrated in FIGS. 4D and 4E, for example. In FIG. 4D, a third leg 121C may be similar or identical to legs 121, but is located such that it is not in-line with legs 121. In FIG. 4E, leg 121C is oriented such that its width 121W is not parallel to the width 121W of the other legs 121.

Such addition legs may serve to provide additional mechanical strength to the sensor module 120, and also to the system 100 when a sensor module is coupled to (e.g., plugged into) a base unit 102. In addition, such additional legs may provide an additional electrical connection to a wiring harness.

For a sensor module 120 with multiple legs 121, a body 102 has a corresponding number of apertures 108 to accept the legs 121 when the sensor module 120 is coupled to the body 102. Further, the placement and orientation of the legs 121, 121C and the corresponding aperture 108 may provide a pattern that prevents a sensor module 120 from being mated to a body 102 in any orientation other than a single, correct orientation. Indeed, in some embodiments, some legs 121 may be conductive, while other legs (e.g., 121C) may be non-conductive, or may even be a part of casing 125, and serve only a mechanical/structural function (e.g., for mating to a body 120) as described above.

Figure 5A:
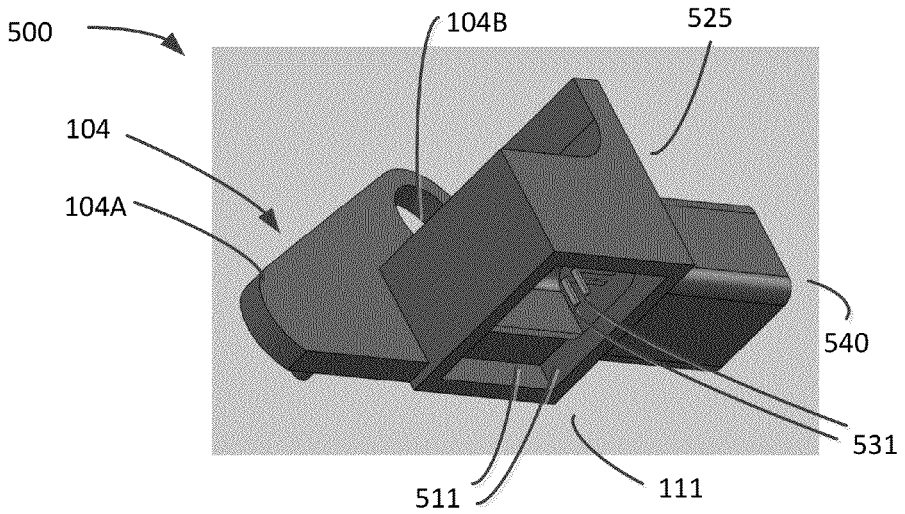
FIGS. 5A-5D schematically illustrate various embodiments of a satellite sensor mounting system.
Figure 5B:
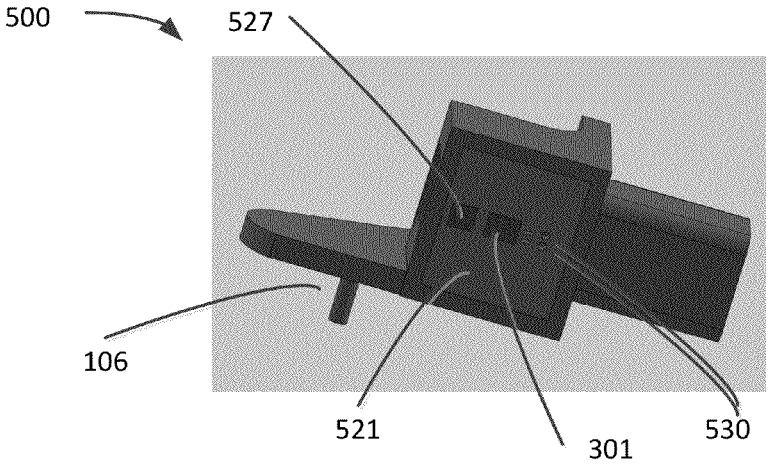
Figure 5C:
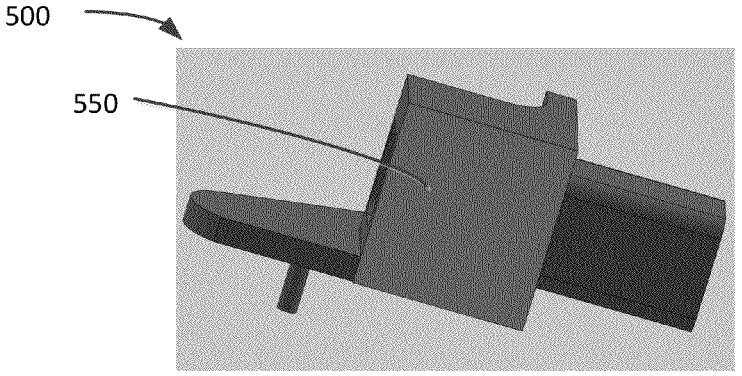

An alternate embodiment of a sensor system 500 is schematically illustrated in FIGS. 5A-5C. System 500 includes many of the same features as system 100, as denoted by common reference numbers, although the shapes, locations, and orientations of such features may vary.

In system 500, the sensor module 520 includes a sensor 301 coupled to a substrate 521, and the substrate 521 is at least partially, and in some embodiments completely, within the cavity 111, as schematically illustrated in FIG. 5B. For example, the sensor module 520 may be snap-fit or press-fit into cavity 111, such that it is held in place by frictional forces between the sensor module 520 and the walls 511 of the cavity 111. The substrate 521 may also include other features 527, such as a battery or RF (wireless) transceiver, for example.

Figure 5D:
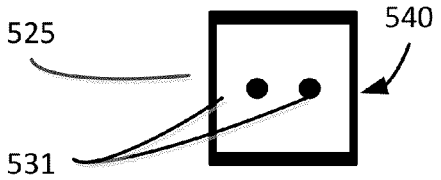

The substrate 521 includes several apertures 530, configured to mate with pins 531 extending from casing 125 into the cavity 111. The pins 531 form an electrical connection with apertures 530, and thereby to the circuitry (e.g., sensor 301) on the substrate 521. The pins 531 also extend through the body (e.g., 525) to form a wiring harness interface 540, as also schematically illustrated in FIG. 5D.

In some embodiments, the cavity 111 is covered by a plate 550, which encloses the substrate 521 and its components within cavity 111. In some embodiments, the plate 550 is hermetically sealed to the casing 525 to provide an environmental seal to the cavity 111.

Figure 6A:
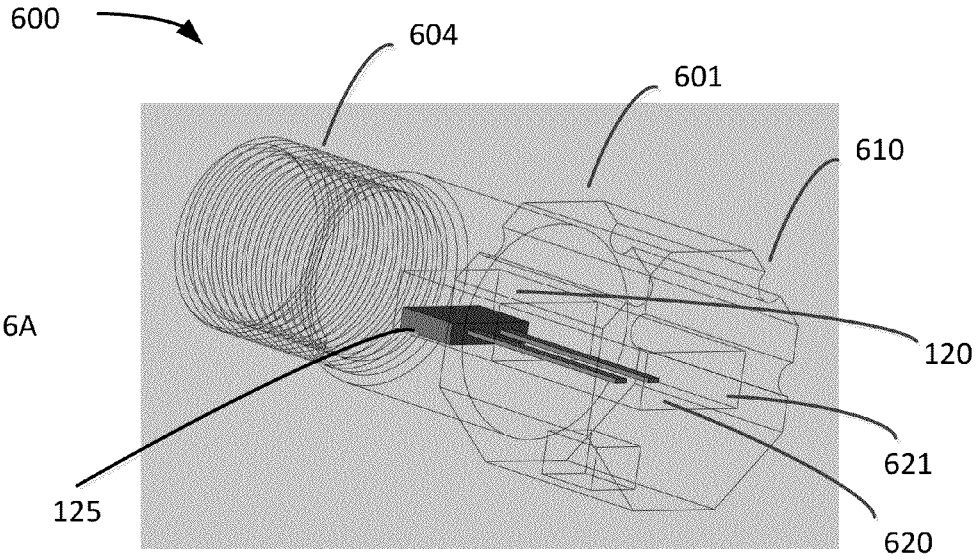
FIGS. 6A-6B schematically illustrate various embodiments of a satellite sensor mounting system.
Figure 6B:
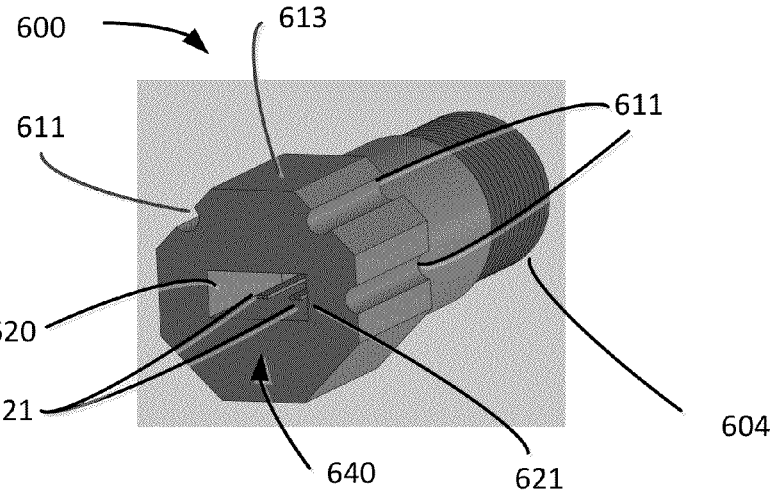

FIGS. 6A and 6B schematically illustrate another embodiment 600 of a base unit 601 that includes a mounting device 604 having a threaded shank 605. The base unit 601 may be metal, molded or machined or 3D-printed plastic, or other polymer. The base unit may include a head portion 610 in addition to the shank 605, and the head portion 610 and shank 605 may form a single, integral unit. In some embodiments, the head portion 610 may have six-faces 613 configured to be driven with a socket wrench, for example, and/or may have features, such as grooves 611, configured to interface with a mounting tool for purposes of turning or screwing the system 600 into a corresponding threaded aperture in a vehicle.

The base unit includes a recess 620 configured to receive a sensor module 120. In particular, the casing 125 of the sensor module 120 is disposed within the recess 620 such that the legs 120 extend towards the opening 621 of the recess in the head portion 610. The casing 125 of the sensor module 120 may fit snugly into the recess 620, so as to be secured within the recess 620 by pressure or friction. As such, the sensor module 120 is secured within the recess 620, such that the base unit 601 and the shank 605 faithfully transmit motion of the vehicle to the sensor module 120. Further, the sensor module 120 may be removable from the recess 620 by pulling on the legs 121, making repair or replacement of the sensor module 120 simple and inexpensive. In other embodiments, the sensor module may be secured within the recess 620 by an epoxy or other adhesive.

The legs 121 are exposed through the opening 621, such that the legs 121, the recess 620 and opening 621 form an interface for the vehicle's wiring harness. For example, a vehicle's wiring harness (e.g., 130) may include one or more connectors (e.g., 133) configured to slide within the recess 620 and make a physical and electrical connection to the legs 121. As such, the recess 620 and legs 121 form a wiring harness interface 640.

Various embodiments disclosed herein potentially provide benefits over previously-known sensor systems. Among the advantages are cost savings arising from the relative simplicity of the systems.

For example, a prior art automobile sensor system includes several levels of assembly, and several of the various components and sub-assemblies require testing at various points in the assembly and installation processes. A typical process for producing a prior-art sensor module includes the following steps: (a) fabricate the sensor (e.g., via a micromachining process); (b) test the sensors (e.g., at wafer level or die level); (c) fabricate a sensor assembly by mounting die and other components onto a substrate (which may be a printed circuit board) and overmolding the substrate and its sensor and other components; (d) test the sensor assembly; (e) fabricate a printed circuit board assembly mount the sensor assembly and other components onto a printed circuit board; (f) test the printed circuit board assembly; (g) mount the printed circuit board assembly into a mounting package, the mounting package configured to be mounted to a vehicle; and (h) mounting the mounting package in a vehicle and coupling the package to flexible portion of the vehicle's wiring harness. As described, the prior art required many steps, many components, and many tests. Each and all of these add complexity and cost to the final product.

In contrast, various embodiments disclosed herein can be fabricated and assembled with fewer fabrication steps and materials, and fewer testing steps. For example, a sensor according to various embodiments may require a process such as the following: (a) fabricate the sensor (e.g., via a micromachining process); (b) test the sensors (e.g., at wafer level or die level); (c) fabricate a sensor assembly by mounting die and other components onto a substrate (which may be, e.g., a printed circuit board or other substrate such as substrate 521, or legs 121) and overmolding, encapsulating or otherwise packaging the substrate and its sensor and other components; (d) test the sensor assembly. Once fabricated according to the foregoing steps, the sensor assembly (e.g., sensor module 120) is ready to be installed in a vehicle by, for example, coupling the sensor module to a base unit (e.g., 101) that is affixed to the vehicle. Among other things, the sensor assembly is ready to be installed in a vehicle without further production testing (i.e., testing performed to validate the proper outcome of the fabrication process). Of course, a complete sensor assembly may be tested at a later time, for example by a vehicle manufacturer, to confirm that the sensor assembly is still functional, but that is a post-production test or a validation text, and not a production test. In other words, the process of fabricating various embodiments as described above is considerably simpler and less expensive than processes for fabricating prior art sensor units.

As described, the process of fabricating various embodiments as described above may eliminate several components of the product (e.g., the printed circuit board assembly) and several process and testing steps [e.g., steps e-g, above]. As such, various embodiments stand to be less expensive in terms of component cost, assembly cost and text cost, and easier to fabricate. Indeed, the various embodiments even stand to be easier to install in a vehicle. Further, in various embodiments the sensor module can even be easily replaced or repaired because the sensor modules (e.g., module 120) is removable from its base, such that the base may remain affixed to a vehicle even when the sensor module is removed or replaced.

Various embodiments of the present invention may be characterized by the potential claims listed in the paragraphs following this paragraph (and before the actual claims provided at the end of this application). These potential claims form a part of the written description of this application. Accordingly, subject matter of the following potential claims may be presented as actual claims in later proceedings involving this application or any application claiming priority based on this application. Inclusion of such potential claims should not be construed to mean that the actual claims do not cover the subject matter of the potential claims. Thus, a decision to not present these potential claims in later proceedings should not be construed as a donation of the subject matter to the public.

Without limitation, potential subject matter that may be claimed (prefaced with the letter "P" so as to avoid confusion with the actual claims presented below) includes:

P1. A device for removably coupling a MEMS sensor to a vehicle, comprising:

a body, the body not including a MEMS sensor;

a mounting device coupled to the body, and configured to affix the body to the vehicle; and a sensor interface coupled to the body, the sensor interface configured to accept a packaged MEMS sensor.

P2. The device of potential claim P1, wherein the sensor interface configured to removably accept a packaged MEMS sensor P3. The device of potential claim P1, wherein the sensor interface is configured to provide an electrical interface with the sensor, and the device further comprising a wiring harness interface.

P4. The device of potential claim P3, wherein the sensor interface is configured such that the electrical interface is environmentally sealed when such a MEMS sensor is coupled to the sensor interface.

P5. The device of potential claim P3, wherein the harness interface is configured to electrically couple directly to a packaged MEMS sensor when such a MEMS sensor is coupled to the sensor interface, such that the MEMS sensor is not in electrical contact with the body.

P6. The device of potential claim P1, wherein the body further comprises a local power storage element, configured to provide power to a MEMS sensor when such a MEMS sensor is coupled to the sensor interface.

P7. The device of potential claim P6, wherein the local power storage element is a battery.

P8. The device of potential claim P1, wherein the mounting device comprises an aperture passing completely through the body, and configured to receive a fastener and to allow the fastener to physically couple to the vehicle.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A device for removably coupling a MEMS sensor to a vehicle, comprising:

a body forming a sensor interface;

a cable integrally extending from the body; and a mounting device coupled to the body, and configured to affix the body to the vehicle, the sensor interface configured to accept a MEMS sensor module, the MEMS sensor module being electrically connected with the cable when accepted by the sensor interface.

2. The device of claim 1, wherein the sensor interface is configured to removably accept the MEMS sensor module.

3. The device of claim 1, wherein the sensor interface has an electrical interface configured to electrically connect the MEMS sensor module with the cable.

4. The device of claim 2, wherein the sensor interface is configured such that the electrical interface is environmentally sealed when the MEMS sensor module is coupled to the sensor interface.

5. The device of claim 1 further comprising the MEMS sensor module coupled with the sensor interface, the MEMS sensor module having sensor interconnects to electrically connect with the cable.

6. The device of claim 1, wherein the body further comprises a local power storage element that is configured to provide power to a MEMS sensor module when the MEMS sensor module is coupled to the sensor interface.

7. The device of claim 1, wherein the mounting device comprises an aperture passing completely through the mounting device, and configured to receive a fastener and to allow the fastener to physically couple to the vehicle.

8. The device of claim 7, wherein the aperture has a non-circular cross-section.

9. The device of claim 8, wherein the aperture comprises internal threads.

10. The device of claim 1, wherein the mounting device comprises a threaded shank.

11. The device of claim 1 further comprising a seal member forming a ring around the sensor interface to form an environmental barrier when the sensor interface receives the MEMS sensor module.

12. The device of claim 1 further comprising an anti-rotation pin that mitigates body rotation.

13. The device of claim 1 further comprising means for connecting the body to a wiring harness.

14. The device of claim 1 wherein the sensor interface has a main portion with an elongated shape, and two apertures for accepting legs of the MEMS sensor module.

15. The device of claim 1 wherein the sensor interface is configured to accept the MEMS sensor module in no more than one orientation.

16. A device for removably coupling a MEMS sensor to a vehicle, the device comprising:

a body having means for receiving a MEMS sensor module;

a cable integrally extending from the body; and means for affixing the body to a vehicle;

the receiving means being configured to accept the MEMS sensor module, the MEMS sensor module being electrically connected with the cable when accepted by the receiving means.

17. The device of claim 16 further comprising means for environmentally sealing the receiving means when accepting the MEMS sensor module.

18. The device of claim 16 wherein the receiving means is configured to removably accept the MEMS sensor module.

19. A method of making a device for removably coupling a MEMS sensor to a vehicle, the method comprising:

forming a body with a sensor interface to accept a MEMS sensor module;

integrally coupling a cable to the body, the cable integrally extending from the body; and coupling a mounting device to the body, the mounting device being configured to affix the body to the vehicle, forming further comprising forming the sensor interface so that the MEMS sensor module is electrically connected with the cable when accepted by the sensor interface.

20. The method as defined by claim 19 wherein forming comprises molding the body to form the sensor interface.

* * * * *